US005570787A

United States Patent [19]

Danovaro et al.

[11] Patent Number: 5,570,787

[45] Date of Patent: Nov. 5, 1996

[54] DEVICE FOR BUNDLING UP CONTAINERS, IN PARTICULAR BEVERAGE CONTAINERS, INTO A UNITARY SET

[76] Inventors: Enrico Danovaro, Via Savona 80, 20144 Milano; Enrico Ghini, Via Marconi 17, 03043 Cassino (Frosinone), both of Italy

[21] Appl. No.: 343,439

[22] PCT Filed: Jun. 25, 1993

[86] PCT No.: PCT/IT93/00067

§ 371 Date: Nov. 23, 1994

§ 102(e) Date: Nov. 23, 1994

[87] PCT Pub. No.: WO94/01342

PCT Pub. Date: Jan. 20, 1994

[30] Foreign Application Priority Data

Jul. 3, 1992 [IT] Italy ..... MI92A1628

[51] Int. Cl.[6] ..... B65D 65/00

[52] U.S. Cl. ..... 206/428; 206/142; 206/427; 206/150

[58] Field of Search ..... 206/142, 143, 206/147, 148, 149, 150, 153, 158, 161, 162, 194, 427, 428

[56] References Cited

U.S. PATENT DOCUMENTS

| | | | |
|---|---|---|---|
| 3,557,516 | 1/1971 | Brandt | 206/428 |
| 4,249,766 | 2/1981 | Erickson | 206/150 |
| 4,269,314 | 5/1981 | Barrash . | |
| 4,300,681 | 11/1981 | Klygis et al. | 206/428 |
| 4,460,084 | 7/1984 | Miller | 206/161 |
| 4,544,194 | 10/1985 | Allen | 206/150 |
| 4,880,115 | 11/1989 | Chaussadas . | |

FOREIGN PATENT DOCUMENTS

| | | |
|---|---|---|
| 0178142 | 4/1986 | European Pat. Off. . |
| 478697 | 11/1969 | Switzerland . |

*Primary Examiner*—David T. Fidei

[57] ABSTRACT

A bundling-up device for container sets comprises a membrane made of plastic material and defined by a tubular band adapted to wrap and tighten a predetermined number of containers disposed in side by side relation, at side portions thereof, as well as a carrying handle for handling the unitary container set.

6 Claims, 2 Drawing Sheets

FIG.1
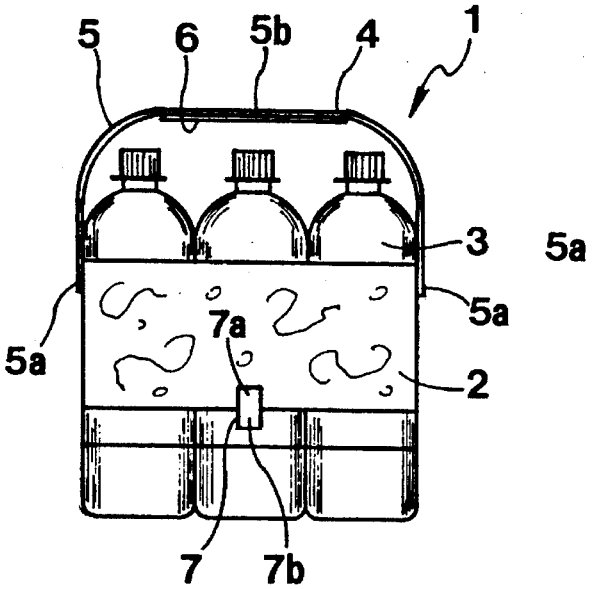
FIG. 2
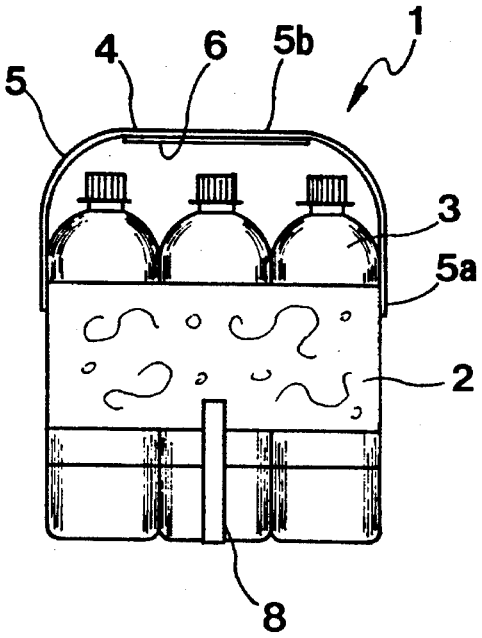
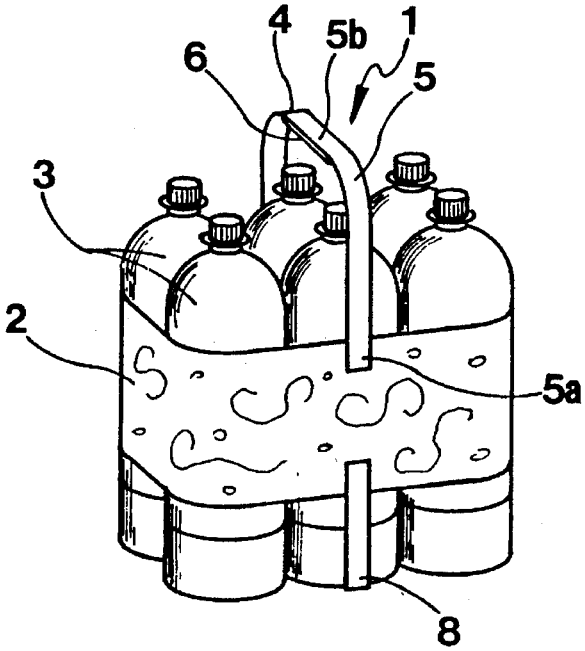
FIG. 4
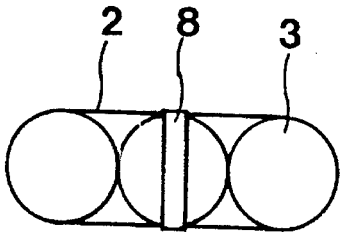
FIG. 3

DEVICE FOR BUNDLING UP CONTAINERS, IN PARTICULAR BEVERAGE CONTAINERS, INTO A UNITARY SET

FIELD OF THE INVENTION

The present invention relates to a device for bundling up containers, in particular beverage containers, into a unitary set, of the type comprising a membrane of plastic material for associating said containers into a unitary set and a carrying handle adapted to enable said unitary set to be handled.

BACKGROUND OF THE INVENTION

It is known that bundling-up or association of containers into unitary packages, in particular beverage containers such as bottles, cans, jars, is presently carried out by packaging elements or "clusters" made of injected or thermoformed plastics or paperboard material generally decorated in advance.

In particular, for packaging 1 liter and bigger bottles into a unitary set, a heat-shrinkable plastics membrane or film is used, a support handle being formed therein or added thereto, which handle is for example made of a strip surrounding the unitary set and passing under it.

In some packages, in addition to plastics membranes, the use of paperboard holding bowls into which the container bottoms are introduced, is also provided.

However, the known bundling-up technique as briefly described above has some limits and inconveniences.

In fact, in case of packages completely or partly made of paperboard material, not only possible wear of the material due for example to dampness and to the weight of the material itself may occur, but also manufacturing costs to be borne are rather high.

As regards packages made of heat-shrunk film, in addition to the important amount of material needed for each unitary set, a non negligible energy consumption is also required due to the heat workings for applying the film.

Furthermore, inscriptions or messages, such as advertisements, cannot be put on said heat-shrunk films, as, on the one hand, they would be deformed due to the material shrinkage during the packaging process and, on the other hand, it would be difficult to position them properly on the packages.

SUMMARY OF THE INVENTION

Under this situation, the technical task underlying the present invention is to devise a bundling-up device capable of substantially obviating the above drawbacks.

Within the scope of this technical task, it is an important object of the invention to provide a bundling-up device which is not only practical and reliable, but also very economic both as regards the device itself and the operating steps necessary to set it up.

Another important object of the invention is to provide a bundling-up device enabling the commercial efficiency of a package of a unitary container set to be improved and the actions for marketing and promoting the carried goods to be consequently implemented.

A still further object of the invention is to provide a bundling-up device making the grip of a unitary container set easier during each of the handling and transportation steps to which it is submitted.

The technical task mentioned and the object specified are substantially achieved by a device for bundling up containers, in particular beverage containers, into a unitary set, which is characterized in that said membrane of plastic material is defined by a tubular band adapted to wrap and tighten said containers disposed in side by side relation in a predetermined number at side portions thereof, said tubular band being made of elastically extensible plastic material.

BRIEF DESCRIPTION OF THE DRAWINGS

Some preferred embodiments of a bundling-up device in accordance with the invention are now given by way of non-limiting examples, with reference to the accompanying drawings, in which:

FIG. 1 shows one embodiment of a bundling-up device applied to a unitary set of three bottles;

FIG. 2 shows a second embodiment of the bundling-up device for a unitary set of three bottles;

FIG. 3 is a bottom view of the device shown in FIG. 2;

FIG. 4 is a perspective view of a bundling-up device applied to a set of six bottles;

DESCRIPTION OF THE PREFERRED EMBODIMENTS

Figure 5:
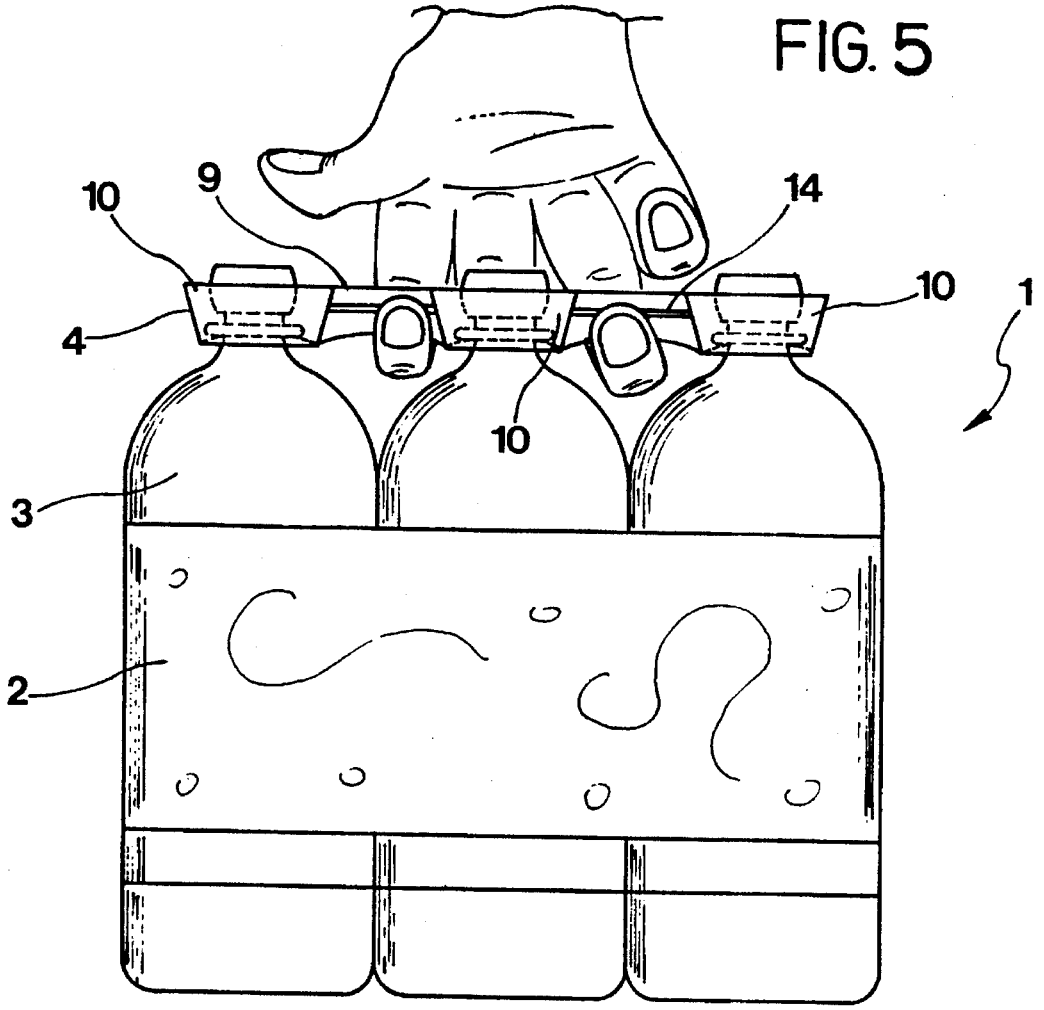
FIG. 5 is a third embodiment of the bundling-up device.
Figure 6:
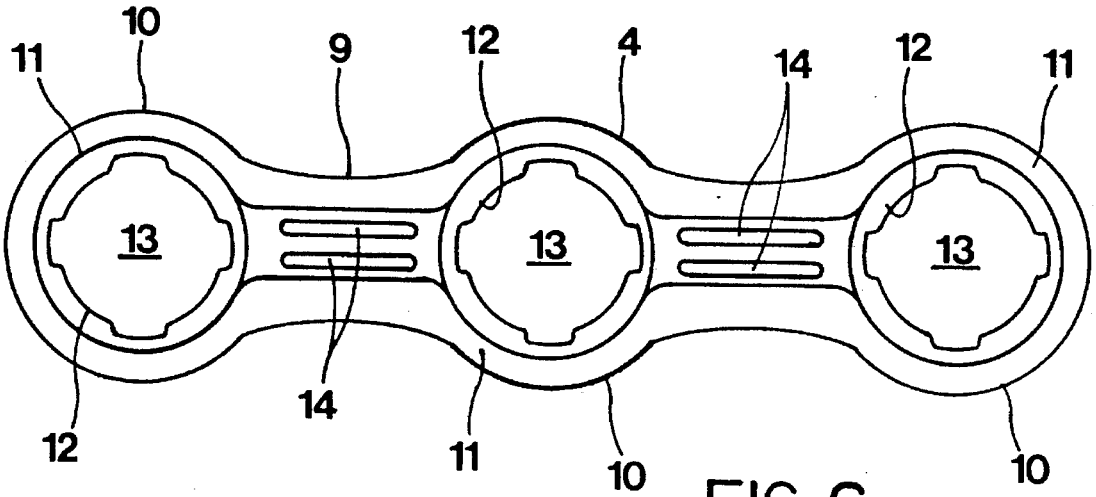
FIG. 6 is a top view of a component of the device shown in FIG. 5.

Referring to the drawings, the bundling-up device in accordance with the invention has been generally identified by reference numeral 1.

It comprises a membrane made of plastic material 2 for associating containers 3, for example beverage bottles, into a unitary set for package, transportation and sale.

This device further comprises a carrying handle 4 adapted to enable the unitary set of containers 3 to be handled.

In an original manner, the membrane 8 is defined by a tubular band or sleeve, made of elastically extensible plastic material, adapted to wrap and tighten the containers 3 disposed in side by side relation in a predetermined number (two, three, four or six for example) at side portions thereof.

The height of the tubular band 2 can be established based on some functional parameters, that is relating to the holding and compactness of the container set, as well as commercial parameters, because, on the other hand, the tubular band 2 constitutes a surface available for decorations and/or advertisements.

The carrying handle 4, in the embodiments shown in FIGS. 1, 2 and 4, comprises an inextensible adhesive tape 5 exhibiting end portions 5*a* applied at least to the tubular band 2 at symmetrically opposite positions thereof and a centre portion serving as handgrip 5*b* and with which a ribbon 6 of paperboard or other material optionally carrying pre-printed inscriptions and/or advertisements is advantageously associated, so as to form the handle 4 underside.

In addition, for example in the case of a set of three containers disposed in a single row, as shown in FIG. 1, the end portions 5*a* of the adhesive tape 5 advantageously engage the end-of-row containers and in the case of a set of six containers disposed in two rows, said tape end portions engage the intermediate containers in the rows (see FIG. 4). In this manner the handle 4 assists in preventing rotation of the container to which it adheres, about its own axis.

While the above described solution is particularly appropriate for sets of two bottles, if the containers to be bundled up in a unitary set are disposed in rectilinear rows of at least three elements, the bundling-up device of the invention comprises at least one auxiliary element for locking of the container or containers located at an intermediate position in each row, to the membrane 2.

More particularly, in the case of three aligned containers, in order to inhibit the elastic tightening. action exercised by the membrane 8 from putting the containers out of alignment and disposing them according to a triangular conformation, in one embodiment shown in FIG. 1 two auxiliary locking elements are provided at symmetrically opposite positions, each defined by an adhesive label 7 or a length of adhesive tape one portion 7*a* of which is applied to the membrane 2 and a second portion 7*b* of which is engaged to the intermediate container.

In a second embodiment of the device 1, shown in FIGS. 2, 3 and 4, the auxiliary locking element is formed with an auxiliary adhesive tape 8 disposed under the bottom of the intermediate container or containers, and applied at both ends to the membrane 2 so as to define a substantially U-shaped staple. In the case of six containers aligned in two rows, it would be better to adopt the auxiliary adhesive tape 8 as the auxiliary locking element, rather than the adhesive labels 7 in order to be quite sure that the intermediate containers do not move out of place, taking into account the fact that the latter are engaged by the membrane 2 over a narrower surface than the end containers.

In a third embodiment the bundling-up device 1, in the particular case in which the containers 3 are embodied by bottles, comprises a carrying handle 4 defined by a support element 9 exhibiting a plurality of attachment seats 10, spaced apart from each other according to pitches corresponding to the distances between the axes of the bottles arranged in a unitary set.

Each attachment seat 10 comprises a collar portion insertable on the neck of a respective bottle and exhibiting a protuberance 12 consisting of flexible tabs facing the inside of a locating opening 13 defined by the collar 11 itself. Said flexible tabs are adapted to engage against a ring-shaped abutment area normally provided in the bottles.

The support element 9 between an attachment seat 10 and the next one exhibits stiffening ribs 14 avoiding the carrying handle 4 being too flexible.

Preferentially, the support element 9 is made of thermoformed and/or moulded plastic material, but at all events it can be manufactured by adopting other techniques providing the use of straps or wires, for example.

Operation of the bundling-up device described above mainly as regards structure, is as follows.

The membrane 2 by elastically tightening the side portions of the containers 3 as in a clamp, prevents the containers themselves from straddling, getting out of alignment and vertically slipping off, and ensures the compactness of the unitary set thus formed.

In the case of sets formed with three aligned containers, the carrying handle made of adhesive tape, by engaging the end containers, assists in inhibiting them from slipping off the tubular band 2.

The adhesive labels or lengths of adhesive tape 7, or the auxiliary adhesive tape 8 not only assist in preventing the containers to which they are applied from rotating about their own axis, but also, counteract the tendency of the containers to get out of alignment.

If the support element 9 is adopted as the carrying handle, it is the support element itself that keeps the bottles in alignment even in the absence of labels or auxiliary adhesive tapes.

Since on lifting the support element 9 tends to bend, the plan projections of the opening in the collar portions 11 become smaller and the protuberances 12 exert a greater pressure against the bottle necks, thereby increasing their abutment and locking action at the ring-shaped locating areas 13 provided on the bottles.

The invention achieves important advantages.

In fact, first of all, the bundling-up device of the invention lends itself to be easily inserted in an automated assembly line formed with apparatus already available on the market. In addition, this device enables a reduction in the weight and amount of material employed for associating the containers into a unitary set, thus achieving an important saving in the packaging costs, without on the other hand adversely affecting the area offered by the package surfaces for promotional purposes-and the practical use of the unitary set for transportation and sale.

Package costs are further decreased as a result of the reduced consumption of energy required by the apparatus for applying the device of the invention to sets of containers, because the operation relating to the application of the components of the device does not need heatings or other workings involving high energy absorption.

In addition, the package thus obtained not only enables easy handling due to the convenient shape of the carrying handle that in the embodiment in which an adhesive tape is provided has a paperboard-made underneath portion making the grip of the unitary set more comfortable, but it is also very functional and of high commercial efficiency. In fact, the large surface available for advertisements or other particular purposes both in the tubular band and the paperboard ribbon of the handle makes the unitary container set an autonomous product, that is independent of the containers themselves. It is pointed out that the tubular band offers a surface for high quality printing, adapted to be exactly positioned and oriented on the unitary set of containers. In addition the marketing actions can be easily differentiated through provision of several different prints on the tubular bands depending on the sale points and the business strategies adopted.

Finally, the tubular band 2, due to its particular position, is adapted to receive a bar code relating to the unitary sale set and also covering the bar codes of the individual containers, so as to facilitate the control and payment operations at the counters, as well as the inspection operations carried out on the stocks.

The particular embodiment shown is also advantageous in its most specific aspects.

The inventions is susceptible of many modifications and variations, without departing from the proper scope of the accompanying claims. In addition, all of the details may be replaced by technically equivalent elements in carrying the invention into effect, the materials, shapes and sizes may be of any nature and magnitude depending on requirements.

We claim:

1. A device for bundling up containers in a unitary set comprising:

a membrane of plastic material for associating said containers into a unitary set:

a carrying handle for handling said unitary set;

said membrane of plastic material being defined by a tubular band adapted to wrap and tighten said containers disposed inside by side relation in a predetermined number at side portions thereof, said tubular band being elastically extensible;

said carrying handle presenting a central handgrip portion and end portions linked to said tubular band at symmetrically opposite areas thereof and to the respective containers disposed at end positions in said unitary set:

said carrying handle is an adhesive tape: and said carrying handle further comprises a ribbon made of paperboard engaged to said adhesive tape at said central portion.

2. A device for bundling up containers into a unitary set comprising:

a membrane of plastic material for associating said containers into a unitary set;

a carrying handle for handling said unitary set;

said membrane of plastic material being defined by a tubular band adapted to wrap and tighten said containers disposed in side by side relation in a predetermined number at side portions thereof said tubular band being elastically extensible;

said carrying handle presenting a central handgrip portion and end portions linked to said tubular band at symmetrically opposite areas thereof and to the respective containers disposed at end positions in said unitary set: and at least one auxiliary locking element engaging said tubular band to at least one container of said unitary set.

3. A device according to claim 2, wherein said auxiliary locking element is embodied by at least one adhesive label or one length of adhesive tape exhibiting one portion engaged to said tubular band and a second portion engaged to said container.

4. A device according to claim 2, wherein said auxiliary locking element is embodied by an auxiliary adhesive tape disposed under the bottom of at least one container of said unitary set and applied at both ends to said tubular band, at symmetrically opposite positions, so as to define a substantially U-shaped staple.

5. A device according to claim 2, wherein said unitary set comprises at least one rectilinear row of at least three containers so as to define end containers and at least one intermediate container, and in that said auxiliary locking element is located at said intermediate container.

6. A device according to claim 2 wherein said carrying handle is an adhesive tape.

* * * * *